United States Patent [19]

McDonald

[11] Patent Number: 4,685,667

[45] Date of Patent: Aug. 11, 1987

[54] AQUATIC EXERCISE SYSTEM

[76] Inventor: Malcolm C. McDonald, 933 W. Linwood, Phoenix, Ariz. 85007

[21] Appl. No.: 871,684

[22] Filed: Jun. 9, 1986

[51] Int. Cl.[4] ..... A63B 69/12; A63B 31/10

[52] U.S. Cl. ..... 272/71; 272/116; 441/58

[58] Field of Search ..... 272/71, 1 B, 93, 130, 272/116, 122, 143, DIG. 4; 441/55-59; 434/254

[56] References Cited

U.S. PATENT DOCUMENTS

| | | | |
|---|---|---|---|
| 2,313,979 | 3/1943 | Tuma | 441/58 |
| 2,850,748 | 9/1958 | Read | 272/71 |
| 3,397,414 | 8/1968 | Webb | 441/56 |
| 4,480,829 | 11/1984 | Yacoboski | 272/93 |
| 4,565,369 | 1/1986 | Bedgood | 272/143 |

*Primary Examiner*—Richard J. Apley
*Assistant Examiner*—S. R. Crow
*Attorney, Agent, or Firm*—Cahill, Sutton & Thomas

[57] ABSTRACT

A series of three separable disk-shaped resistance members have similar openings in the central regions thereof, which, when aligned, permit two or more of the members to be grasped in the hand of the user and moved in unison through the water to exercise the arm of the user. Each resistance member has a face area which is different from the face area of the other two so the resistance members can be utilized singly or in various combinations to adjust the resistance to movement to that desired by the user. The resistance members are made of light-weight, plastic material and the larger members tend to distort when moved through the water by an adult. Reinforcement and prevention of distortion of the larger member is effected by associating one or more of the smaller members with the larger member when it is being used.

4 Claims, 5 Drawing Figures

AQUATIC EXERCISE SYSTEM

TECHNICAL FIELD

This invention is concerned with the construction of hand-held implements for exercising the human body in an aquatic environment.

BACKGROUND ART

The benefits of exercising the human body in water have long been recognized. It has been suggested that these benefits can be enhanced by providing hand-held implements for increasing the resistance to movement of the arms through the water. This requires the exertion of muscular effort beyond that required for merely swimming or swinging one's arms under water. The use of such implements makes it possible to strengthen and tone the arm, shoulder and chest muscles associated with movement of the arms.

U.S. Pat. No. 4,509,744, granted Apr. 9, 1985, to Robert L. Beasley, for "Aquatic Exercise Device With Rigid Fluid Resistance Member" discloses the use of a rigid vane mounted on the hand and wrist of the user for increasing the resistance to movement of the arm of the user through the water. U.S. Pat. Nos. 2,109,429, granted Feb. 22, 1938 to A. S. Malm, for "Swimming Device" and 2,569,200, granted Sept. 25, 1951 to E. V. Smith, for "Swimming Paddle" disclose rigid hand-held paddles which, although proposed as aids in swimming, function to increase the resistance to movement of the swimmer's arms through the water and therefore could be viewed as implements for enhancing the swimming exercise.

A principal shortcoming of the devices disclosed in these prior patents is their lack of any provision for altering, or adjusting, the degree of resistance offered against movement of the user's arms through the water. In addition, each of these prior devices is constructed of rigid materials which means that the cost of the devices may be more than is desired for widespread sale of such devices for home use.

DISCLOSURE OF THE INVENTION

This invention contemplates overcoming the shortcomings of the prior art by constructing the fluid resistance implement of a series of separable plate-like resistance members having different face areas. Each resistance member has opening means in the central region thereof permitting the member to be grasped in the hand of the user. The several resistance members of the series can be used individually to provide the user with his personally selected degree of resistance; it being appreciated that the resistance members with the larger face area would offer greater resistance to movement of the arm through the water.

The invention further contemplates that by placing two or more of the series of resistance members in face to face relationship with their opening means aligned the resistance members can be grasped in the hand of the user and moved in unision through the water. This latter association of two or more resistance members offers the advantage that the smaller resistance members have the effect of reinforcing the larger resistance member or members. This reinforcement affords a real benefit because it permits the several resistance members of the series to be fabricated from thin, relatively flexible and inexpensive sheet plastic materials which can be easily and inexpensively worked to provide the desired configuration of the members. With this invention it is possible to fabricate the resistance members from such thin, flexible materials that the larger member or members would actually distort undesirably when moved individually through the water by an adult attempting vigorous exercise. But when such large, thin resistance members are augmented with, or reinforced by, similar, but smaller, resistance members placed in face to face relationship therewith and also gripped in the hand of the user, undesirable distortion can be prevented. The absence of any form of fastener between the several resistance members of the series renders separation and reassembly of the members in the series a speedy and effortless task.

BRIEF DESCRIPTION OF THE DRAWING

This invention is described in greater detail hereinafter be reference to the accompanying drawing wherein.

BEST MODE FOR CARRYING OUT THE INVENTION

Figure 1:
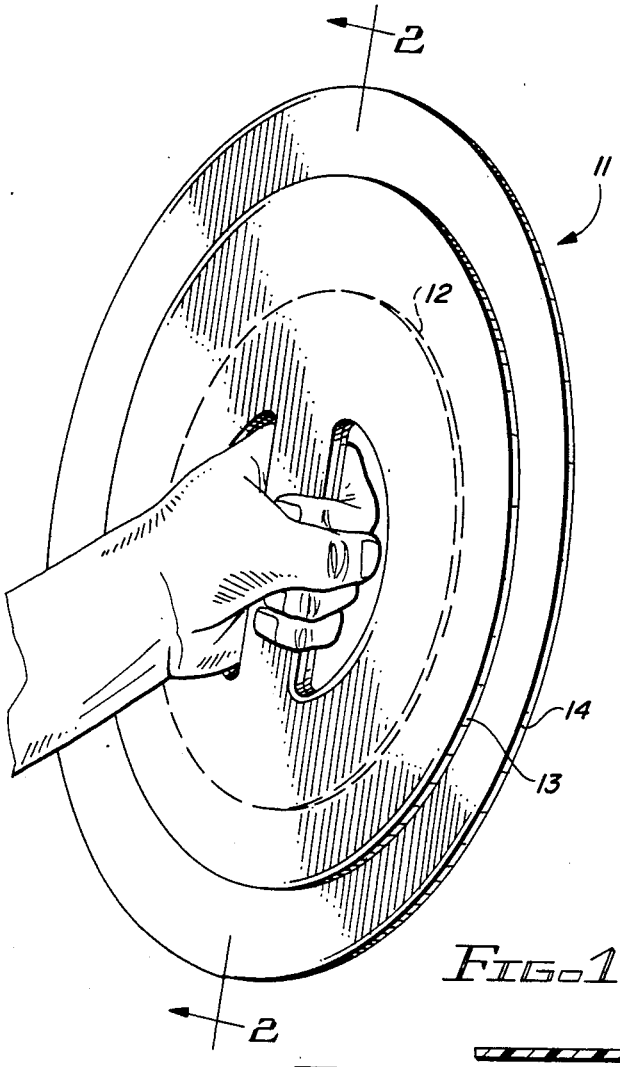
FIG. 1 is a perspective view of the exercise implement of this invention held in the hand of a user.
Figure 2:
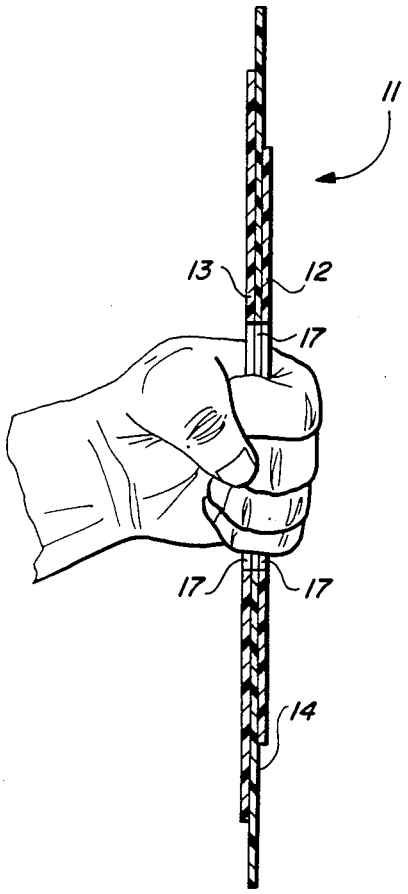
FIG. 2 is a sectional view through the implement taken generally as indicated by the line 2—2 in FIG. 1.
Figure 5:
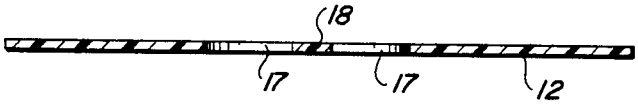
FIG. 5 is a sectional view through one of the resistance members taken gererally as indicated by line 5—5 in FIG. 3.
Figure 4:
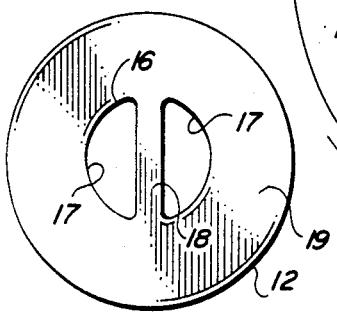
FIG. 4 is a plan view on a reduced scale of one face of one resistance member employed in the implement.
Figure 3:
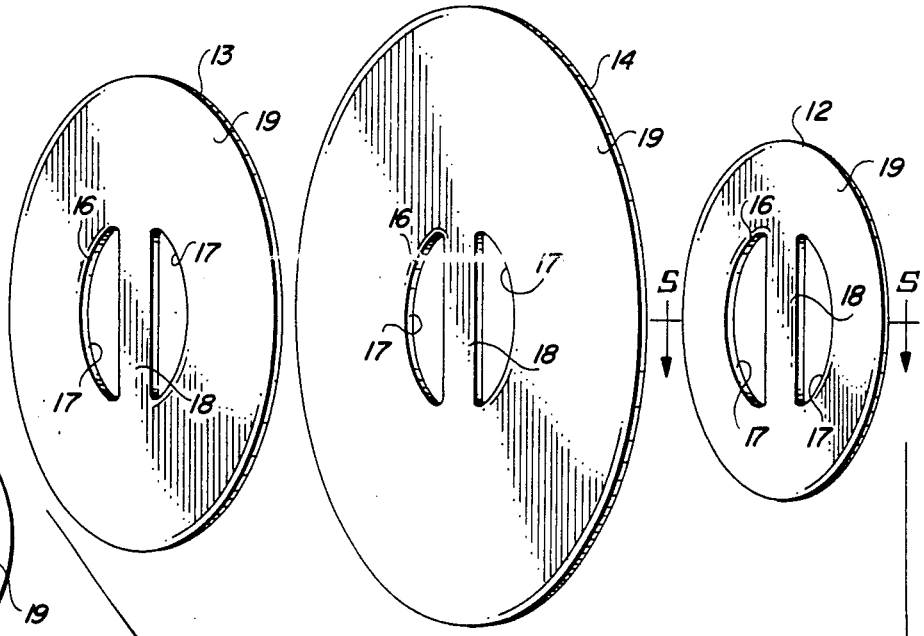
FIG. 3 is a ¾ perspective view of three different sized resistance members constituting a series of members forming the implement illustrated in FIGS. 1 and 2.

The exercise implement constructed in accordance with this invention is designated in FIG. 1 by reference numeral 11 and is comprised of a series of separable, resistance members 12, 13 and 14 shown in FIGS. 2 and 3. Each of the resistance members 12, 13 and 14 is preferably a thin plate-like disk (See FIG. 4) of a sheet plastic or other water resistant material.

Each of the resistance members 12, 13 and 14 has opening means 16 in the central region thereof to permit the resistance members to be grasped by the hand of the user. These opening means 16 are preferably in the form of a pair of slots 17 spaced apart to provide a grip strip 18 in each resistance member. The opening means 16 in each of the resistance members 12, 13 and 14 are identical and are aligned when the resistance members are coaxially arranged in face to face relationship. When thus positioned, as shown in FIG. 2, the several resistance members 12, 13 and 14 can be grasped simultaneously by placing the hand through opening means 16 and grasping the several grip strips 18 together.

It is particularly to be noted that each of the resistance members 12, 13 and 14 has a surface area for its face 19 which is different from the surface area of the face 19 of the other resistance members. This imparts to the exercise implement 11 a degree of adjustability with respect to the resistance to movement of the implement through the water. By separating the resistance members 12, 13 and 14 it is possible to use them individually to give three different levels of resistance to movement of the arm of the user through the water. The least resistance is offered, of course, by the smaller resistance member 12 and the greatest resistance is offered by the largest resistance member 14. Resistance member 13 offers an intermediate level of resistance.

With this invention it is contemplated that the resistance members 12, 13 and 14 will be made of an inexpensive, light-weight plastic material in order to reduce the raw material and manufacturing cost of the implement 11. With very inexpensive and light-weight materials, the larger resistance members 13 and 14 may have a tendency to distort or bend when used alone and subjected to the vigorous exercise forces of an adult. Distortion may be undesirable because it tends to reduce the effective resistance which can be offered by resistance members to an amount that is below that desired by the user. To prevent such distortion of the larger resistance members it is possible to use the smaller members 13 and 12 with the larger member 14 to reinforce and stiffen the larger member. Similarly, the smaller member 12 can be used to reinforce intermediate member 13. The result is that the implement 11 is so constructed as to afford the user the opportunity to adjust the degree of resistance offered by the implement while at the same time insuring that with the larger resistance members in place they will be stabilized by other resistance members in the series even though all of the resistance members 12, 13 and 14 of the series are made of light-weight, thin, flexible and inexpensive material.

It has been discovered that a useful range of resistance can be provided for an adult exerciser by manufacturing the implement 11 with three resistance members 12, 13 and 14 having respective outside diameters of 9 ½ inches, 12 inches and 14 inches. It has also been ascertained that although the resistance members 12, 13 and 14 can be manufactured from a variety of materials, such as aluminum, wood or plexiglass, a sheet of polycarbonate plastic material is particularly suited for this application because of its resistance to water and the chemicals normally found in a swimming pool. Sheets of plastic material having a thickness 3/16 inch and less are suitable. With such thin materials the resistance members can be die cut in a simple, light-weight press.

While the invention has been described by reference to an implement 11 comprised of disk-like resistance members 12, 13 and 14 it can be readily appreciated that the configuration of the resistance members need not be a perfect circle and that other shapes, such as ovals and rectangles can be used. Similarly, the invention is not limited to an implement 11 having three resistance members. The implement should have at least two resistance members and, of course, may have a number in excess of three.

What is claimed is:

1. An aquatic exercise system comprising a series of at least two separable, thin, plate-like resistance members, one of said resistance members having a larger face area than another of said resistance members, said resistance members each having a nearly identical pair of spaced openings in a central region thereof providing grip strips by which the resistance members can be grasped and held in the hand of the user when the members are disposed in face to face relationship with their openings in alignment, said resistance members being formed of light-weight, flexible material whereby the larger of the resistance members can be distorted when moved through the water in the grasp of an adult, the other of said resistance members serving to reinforce and prevent distortion of said larger resistance member when the resistance members are moved through the water in unison by the user.

2. The exercise system of claim 1 wherein said series comprises three resistance members each having a different face area than the other two.

3. The exercise system of claim 1 wherein said resistance members are disk-shaped.

4. The exercise system of claim 3 wherein said series comprises three resistance members each having a different face area than the other two.

* * * * *